United States Patent [19]

Farrell et al.

[11] Patent Number: 4,977,838

[45] Date of Patent: Dec. 18, 1990

[54] MODULAR DOOR JAMB AND LINTEL SYSTEM FOR INDUSTRIAL FURNACES

[75] Inventors: Kenneth L. Farrell, Frankfort; John A. Cona, Orland Park; Ronald Glugla, Mokena; Lloyd G. Bly, Mokena, all of Ill.

[73] Assignee: M. H. Detrick Co., Mokena, Ill.

[21] Appl. No.: 390,362

[22] Filed: Aug. 7, 1989

[51] Int. Cl.[5] ..... F26B 17/12

[52] U.S. Cl. ..... 110/173 R; 34/181; 49/380

[58] Field of Search ..... 110/173 R, 336, 173 A, 110/180, 181; 49/380

[56] References Cited

U.S. PATENT DOCUMENTS

| | | | |
|---|---|---|---|
| 1,311,436 | 7/1919 | Bell | 110/173 R |
| 1,483,978 | 2/1924 | Keenan | 110/173 R |
| 1,611,819 | 12/1926 | Davison | 110/180 |
| 1,792,947 | 2/1931 | Watson | 110/180 |
| 2,003,154 | 5/1935 | Menough | 110/173 R |
| 2,673,534 | 3/1954 | Robinson | 110/173 R |
| 2,781,747 | 2/1957 | Braun | 110/180 |
| 2,854,842 | 10/1958 | Hosbein et al. | 110/336 |
| 3,120,217 | 2/1964 | Reighart | 110/180 |
| 4,429,641 | 2/1984 | Early | 110/181 |

*Primary Examiner*—Edward G. Favors
*Assistant Examiner*—Denise L. F. Gromada
*Attorney, Agent, or Firm*—Wood,Phillips,Mason,Recktenwald & VanSanten

[57] ABSTRACT

A modular door jamb and lintel system for an industrial furnace having an access door opening. A module is provided with a pair of spaced, generally vertical door jambs of precast refractory material. A refractory lintel spans the door jambs and combines therewith to define a frame for the access opening. Hangers are provided on the lintel to facilitate transporting and installing the lintel in position at the access opening. Fasteners are provided on at least the door jambs to facilitate securing the door jambs to appropriate structural members about the access opening.

16 Claims, 3 Drawing Sheets

MODULAR DOOR JAMB AND LINTEL SYSTEM FOR INDUSTRIAL FURNACES

FIELD OF THE INVENTION

This invention generally relates to industrial furnaces and, particularly, to a modular system for rapidly replacing the door jambs and lintels surrounding access door openings of such furnaces.

BACKGROUND OF THE INVENTION

Industrial furnaces, such as aluminum furnaces, forging furnaces and the like, typically are fabricated with a surrounding support structure lined with refractory material which may be precast or laid up of refactory tile or brick. One or more access openings are required to allow for interior maintenance, charging of the furnace or other procedures wherein access must be gained to the interior of the furnace. It is a constant problem in the industry to minimize down time during a furnace turnaround. A furnace "turnaround" is a term commonly used to describe the period during which a furnace is repaired, charged or the like.

The access openings to the interior of such furnaces are closed by a door which simply is set in place but which is fabricated of refractory material to protect the surrounding furnace support structure, which may be fabricated of steel, from heat damage. The door should prevent heat leakage past the edges of the door. In addition, with a furnace operating at a positive pressure, it is desirable to eliminate fugitive gas emissions.

The problem of minimizing down time during furnace turnaround is magnified because the surrounding structure, door jambs, lintels, etc. most often are damaged considerably during repairs, charging and other procedures. Minor damage can destroy the door seal system and result in major damage from heat leakage. Major damage can result from mechanical abuse, as by equipment around the access door opening. Consequently, repair or replacement of door jambs and lintels about the furnace access openings is a very frequent problem. It may take as much as a full day to fully repair the refractory framing structure about the access opening and, obviously, this results in expansive down time during the overall furnace turnaround procedures.

This invention is directed to providing a modular door jamb and lintel system for the access door openings of such industrial furnaces to allow for ready replacement thereof and greatly reduce down time during furnace turnaround.

SUMMARY OF THE INVENTION

An object, therefore, of the invention is to provide improvements in industrial furnaces, particularly in the area of the door jambs and lintels of the access door openings of such furnaces.

In the exemplary embodiment of the invention, the modular door jamb and lintel system includes a pair of spaced, generally vertical door jambs of precast refractory material. Refractory lintel means are assembled to and span the door jambs and combine therewith to define a frame for the access opening. Hanger means are provided on the lintel means to facilitate transporting and installing the lintel means in position at the access opening. Fastening means are provided on at least door jambs to facilitate securing the assembled door jambs to the structural means surrounding the access opening. As disclosed herein, the fastening means are provided in the form of internally threaded members embedded in the precast material of the door jambs for receiving complementary externally threaded fastening members, such as bolts. The hanger means are in the form of hook-like members. The precast material of the door jambs preferably include approximately 60% Alumina material.

In the preferred embodiment, the lintel means is in the form of an assembly including a cross support member, such as an external steel beam, and a top wall of refractory brick hanging from the cross support member. The hanger means are disposed on the cross support member for facilitating transporting and installing the system. As illustrated, the refractory brick wall of the lintel assembly includes a plurality of layers of interlocking refractory bricks shaped such that a lower layer of bricks hangs from an upper layer of bricks in an interlocking fashion.

The door jambs are shaped in cross-section to provide a sealing recess for an appropriate door, and the lintel assembly includes a complementarily shaped brick member overlying the top of each door jamb.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
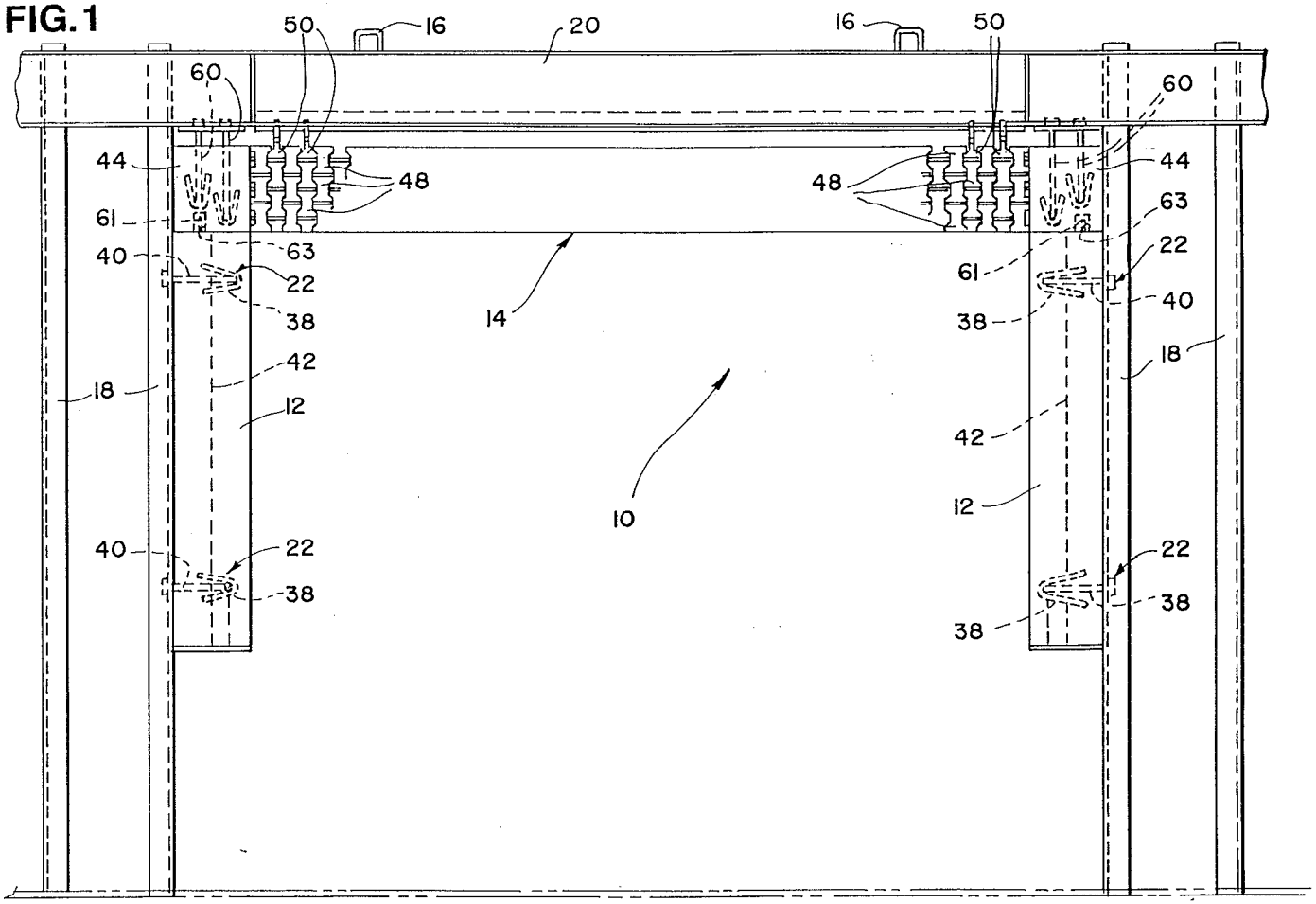
FIG. 1 is an elevational view of the modular door jamb and lintel system of the invention, surrounded by supporting structural beams of an industrial furnace.

Referring to the drawings in greater detail, and first to FIG. 1, the invention contemplates a modular door jamb and lintel system, generally designated 10, for positioning in an access door opening of an industrial furnace or the like. Generally, the system includes a pair of side door jambs 12 which are horizontally spaced and vertically extending generally parallel to each other, and lintel means, generally designated 14, in the form of a lintel assembly. These basic components can be completely preassembled off-site and installed quickly in situ to provide for rapid furnace turnaround. Hanger means in the form of hooks 16 are provided for lifting, transporting and installing the system by appropriate machinery.

FIG. 1 illustrates that the furnace includes an external support structure, such as vertical steel beams 18 along the sides of the access opening, and a upper horizontal steel I-beam 20 along the top of the access opening. The modular door jamb and lintel system is secured in place by fastening means, generally designated 22, between door jambs 12 and inner beams 18, as seen best in FIG. 1.

Figure 2:
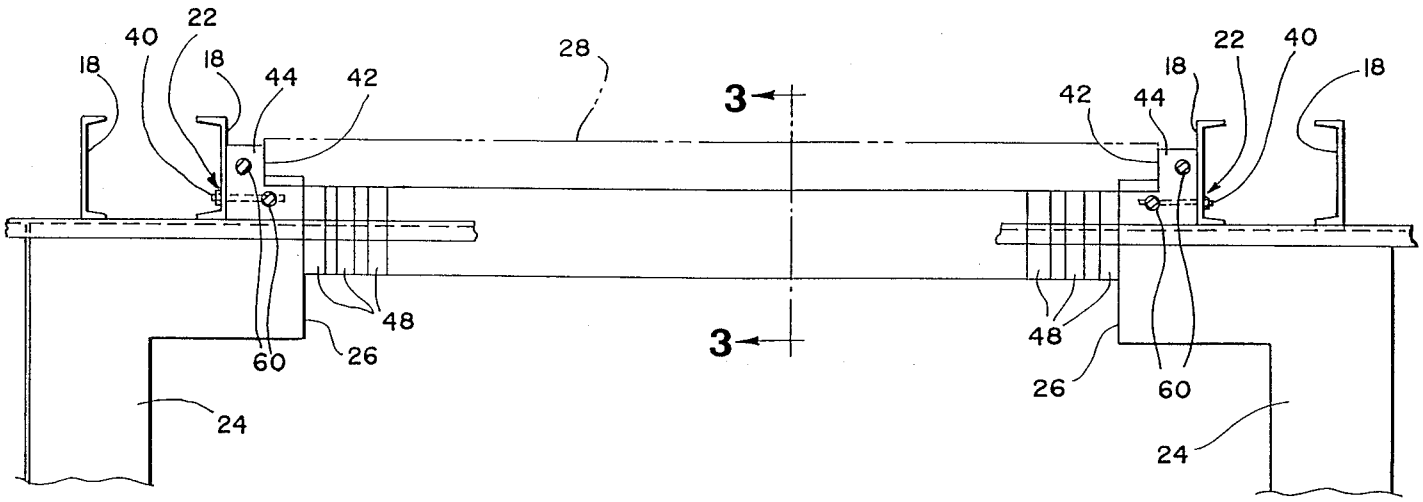
FIG. 2 is a top view of the system shown in FIG. 1, with the upper support members removed, to illustrate the positioning of the modular door jamb and lintel system relative to the adjacent furnace walls and exterior support structure.

Before going into details of the door jamb and lintel system, reference next is made to FIG. 2 to further understand the surrounding structure of the access door opening of the industrial furnace. In FIG. 2, the upper support structures, beams, etc. have been removed to show the location of vertical beams 18 and fastening means 22 in relation to the interior of the furnace. More particularly, industrial furnaces, such as forging furnaces, aluminum furnaces and the like, include refractory walls 24 which may be precast, laid up of refractory brick or other lining material and which are supported by external structural means, such as steel beams like beams 18, 20. As seen in FIG. 2, the refractory walls define an access door opening 26. A door 28 is shown in phantom for closing the opening. It should be understood that the specific construction of the furnace itself does not comprise an integral portion of the invention, except to the extent that structural means, such as inner beams 18, should be provided for rapidly fastening the door jamb and lintel system in place. Industrial furnaces come in various sizes, styles and grades, and one of the advantages of the invention is that the modular door jamb and lintel system can be customized and provided in numbers for inventory purposes to afford quick replacement installation and allow for rapid furnace turnaround.

Figure 3:
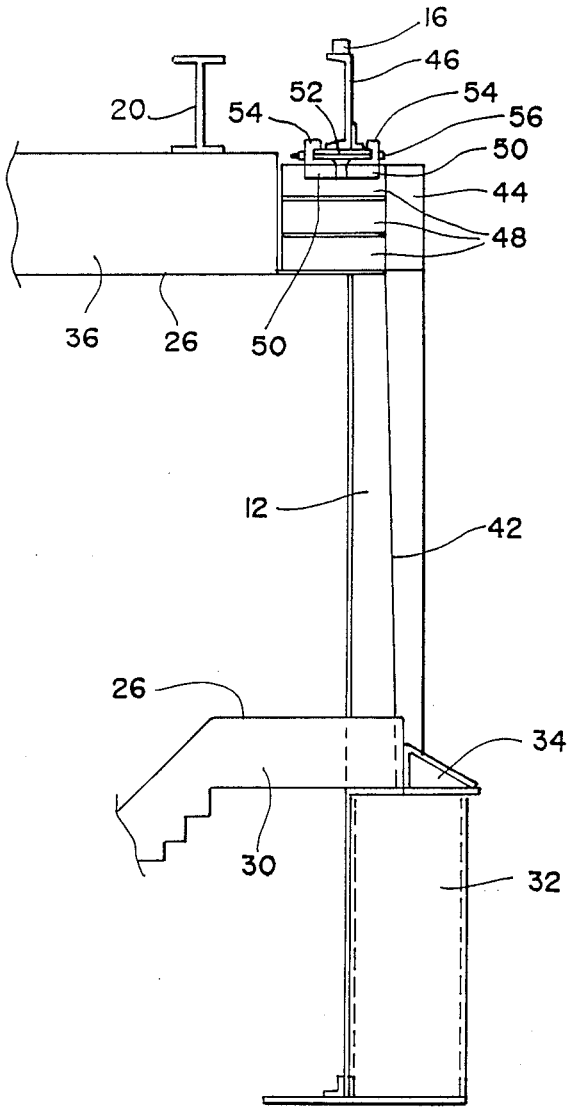
FIG. 3 is a vertical section, taken generally along line 3—3 of FIG. 2.

Reference is made to FIG. 3 before going into details of the modular system of the invention, to further illustrate that an industrial furnace will have a bottom wall 30 of refractory material, usually extending inwardly and downwardly toward the base of the furnace, along with a lower front foundation 32 supporting a door sill 34. Above access opening 26, exterior supporting I-beam 20 is shown, along with a upper interior refractory wall 36 defining the top of the access opening.

The invention contemplates that the modular door jamb and lintel system 10 be easily and rapidly installed. To this end, each fastening means 22 includes a fastening member 38 (FIG. 1) embedded within the precast door jambs. The fastening members are shown schematically and, generally, are in the form of anchors buried in the refractory material, with a precast bore leading thereto. The anchors may comprise internally threaded inserts for receiving an externally threaded bolt 40 to secure the door jambs and, therefore, the modular system to the inside ones of the pairs of external steel beams 18, as best seen in FIGS. 1 and 2. This simplifies installation of the modular system in tight spaces, keeping in mind that the structural steel supports or beams are located exteriorly of the furnace.

As seen best in FIGS. 2 and 3, door jambs 12 are configured in a L-shape in cross-section to provide a stepped recess 42. Actually, the stepped recess is best shown in FIG. 2, but the tops of the door jambs are covered with a complementarily shaped refractory brick 44 (described hereinafter) at the top of each door jamb. In any event, FIG. 2 shows that these recesses in the door jambs provide a circuitous or tortuous path about door 28 (FIG. 2) and forms an area for the door to seal against. This protects the door and furnace exterior steel from heat damage due to heat leakage past the edges of the closed door. This also allows the furnace to operate at a positive pressure and eliminates fugitive gas emissions. Finally, door jambs 12 preferably are fabricated of approximately 60% Alumina precast material which is prefired and reinforced with stainless steel "needles" to resist mechanical abuse from charging and scraping equipment.

Referring to FIGS. 1 and 3, lintel means 14 is in the form of an assembly including an upper cross support member in the form of a steel beam 46 (FIG. 3) having hangers 16 projecting upwardly therefrom. A wall of refractory bricks 48 depend or hang from cross support member 46. It can be seen in FIG. 1 that the refractory bricks 48 are generally I-shaped in cross-section so that they interlock in vertical layers. Inverted T-shaped hanging members 50 interlock with the I-shaped brick in the upper layer thereof, as best seen in FIG. 1. As seen in FIG. 3, a support plate 52 is fixed to the bottom of cross support member or beam 46, as by welding, and each hanging member 50 has an upper hook portion 54 which hooks over an edge of plate 52. Bolts 56 project through opositely facing pairs of hanging members 50 to clamp the hanging members against the edges of plate 52, with hooks 54 overlying the top of the plate.

The top bricks 44 described in relation to FIG. 2, are disposed at opposite ends of the wall of refractory bricks 48 of the lintel assembly and are shaped, in horizontal cross-section, complementarily to door jambs 12 to define recess 42 for door 28. As seen best in FIG. 1, top bricks 44 are secured to cross support member 46 (FIG. 3) by fastening means, generally designated 60, which may be similar to fastening means 22, so that bricks 44 hang from cross support member 46.

The door jambs 12 may be secured to top bricks 44, as by appropriate fastening means (not shown) such as fastening means 22, so that an entire unit consisting of door jambs 12 and lintel means 14 can be transported and installed together. On the other hand, the door jambs can be fastened to beams 18 first, and then the entire lintel assembly, including top bricks 44, can be lowered in place on top of the door jambs. To this end, an index or locating pin 61 is embedded in and projects upwardly from the top of each door jamb 12. Each top brick 44 has a locating recess 63 for receiving the respective locating pin 61 and thereby properly positioning the lintel assembly on top of the door jambs.

From the foregoing, it can be seen that the modular door jamb and lintel system 10 of the invention, including the basic components of door jambs 12 and the assembly of lintel means 14, can be completely prefabricated off-site and transported to the furnace by hanger means 16 at the top of cross support member 46 of the lintel assembly. Once positioned in access opening 26 defined by interior furnace walls 24, 30 and 36, the module can be secured in the access opening by fastening means 22. Door 28 then simply is positioned in the recess 42 defined by door jambs 12 and upper bricks 44, and against the face of the wall of refractory bricks 48, and the job is completely finsished. It has been found that a complete replacement of the door jambs and lintel means according to the concepts of the invention, during an industrial furnace turnaround, can take on the order of a couple of hours in comparison to the loss of a complete day heretofore to repair or reconstruct the access opening in industrial furnaces.

It will be understood that the invention may be embodied in other forms without departing from the spirit or central characteristics thereof. The present examples and embodiments, therefore, are to be considered in all respects as illustrative and not restrictive, and the invention is not to be limited to the details given herein.

We claim:

1. A modular door jamb and lintel system for an industrial furnance having an access door opening defined by structural means, comprising:

a pair of spaced, generally vertical door jambs of precast refractory material;

refractory lintel means assembled to and spanning the door jambs and combining therewith to define a frame for said access opening, the refractory lintel means being in the form of a cross support member and a wall of a plurality of self-supporting layers of interlocking refractory brick hanging from the cross support member;

fastening means on at least the door jambs to facilitate securing the door jambs to said structural means; and hanger means on the lintel means to facilitate transporting and installing the lintel means in position at the access opening.

2. The modular door jamb and lintel system of claim 1 wherein said fastening means are embedded in the precast material of the door jambs.

3. The modular door jamb and lintel system of claim 2 wherein said fastening means comprise internally threaded members for receiving complementary externally threaded fastening members.

4. The modular door jamb and lintel system of claim 1 wherein said hanger means comprise hook-like members.

5. The modular door jamb and lintel system of claim 1 wherein the precast material of said door jambs include approximately 60% Alumina material.

6. The modular door jamb and lintel system of claim 1 wherein said hanger means are disposed on said cross support member.

7. The modular door jamb and lintel system of claim 1 where said interlocking refractory bricks are shaped such that a lower layer of bricks hangs from an upper layer of bricks in an interlocking fashion.

8. The modular door jamb and lintel system of claim 1 wherein said door jambs are shaped in cross-section to provide a sealing recess for a door, and said lintel assembly includes a complementarily shaped brick member overlying the top of each door jamb.

9. The modular door jamb and lintel system of claim 1 wherein said door jambs are shaped in cross-section to provide a sealing recess for a door, and said lintel means includes a complementarily shape top brick member overlying the top of each door jamb.

10. The modular door jamb and lintel system of claim 9, including complementary position indexing means between the top brick members and the door jambs.

11. A modular door jamb and lintel system for an industrial furnace having an access door opening defined by structural means, comprising:

a pair of spaced, generally vertical door jambs of precast refractory material shaped in cross-section to provide a sealing recess for a door;

lintel means including a plurality of refractory bricks spanning the door jambs and combining therewith to define a frame for the access opening, and including an enlarged brick member overlying the top of each jamb and shaped in cross-section complementarily to the cross-section of the respective door jamb;

fastening means on at least the door jambs to facilitate securing the door jambs to said structural means; and hanger means on the lintel means to facilitate transporting and installing the lintel means in position at the access opening.

12. The modular door jamb and lintel system of claim 11 wherein said fastening means are embedded in the precast material and comprise internally threaded members for receiving complementary externally threaded fastening members.

13. The modular door jamb and lintel system of claim 11 where said hanger means comprise hook-like members.

14. The modular door jamb and lintel system of claim 11 wherein said refractory lintel means comprises an assembly including a cross support member and a wall of refractory brick hanging from the cross support member.

15. The modular door jamb and lintel system of claim 14 wherein said hanger means are disposed on said cross support member.

16. The modular door jamb and lintel system of claim 14 wherein said wall includes a plurality of layers of interlocking refractory bricks.

* * * * *